US009295364B2

(12) United States Patent
Eriksson

(10) Patent No.: US 9,295,364 B2
(45) Date of Patent: Mar. 29, 2016

(54) BRUSHROLL CLEANING FEATURE WITH SPACED BRUSHES AND FRICTION SURFACES TO PREVENT CONTACT

(71) Applicant: AKTIEBOLAGET ELECTROLUX, Stockholm (SE)

(72) Inventor: Henrik Eriksson, Stockholm (SE)

(73) Assignee: Aktiebolaget Electrolux (SE)

( * ) Notice: Subject to any disclaimer, the term of this patent is extended or adjusted under 35 U.S.C. 154(b) by 326 days.

(21) Appl. No.: 13/826,630

(22) Filed: Mar. 14, 2013

(65) Prior Publication Data

US 2013/0192022 A1 Aug. 1, 2013

Related U.S. Application Data

(63) Continuation of application No. 12/405,761, filed on Mar. 17, 2009, now Pat. No. 8,601,643.

(60) Provisional application No. 61/037,167, filed on Mar. 17, 2008.

(51) Int. Cl.
*A47L 5/10* (2006.01)
*A47L 5/26* (2006.01)
(Continued)

(52) U.S. Cl.
CPC ..... *A47L 9/2831* (2013.01); *A46B 13/006* (2013.01); *A47L 9/0477* (2013.01); *A47L 9/0494* (2013.01);
(Continued)

(58) Field of Classification Search
CPC ..... A47L 9/2831; A47L 11/4041; A47L 11/4069; A47L 9/0477; A47L 11/1011; A47L 9/2889; A46B 9/2831
USPC ..... 15/48, 319
See application file for complete search history.

(56) References Cited

U.S. PATENT DOCUMENTS 804,213 A 11/1905 Chaplin
969,441 A 9/1910 Backer
(Continued)

FOREIGN PATENT DOCUMENTS

CN 1593320 3/2005
CN 1816300 8/2006
(Continued)

OTHER PUBLICATIONS

International Search Report for International Application No. PCT/EP2012/076620 mailed Jul. 23, 2013.
(Continued)

*Primary Examiner* — Bryan R Muller
(74) *Attorney, Agent, or Firm* — RatnerPrestia

(57) ABSTRACT

A cleaning device agitator system having an agitator and one or more cleaning members. The agitator has first and second ends, a longitudinal axis and one or more agitating devices. One or more friction surfaces may project from the spindle. The cleaning members are adjacent the agitator and adapted to move between a first position and a second position. In at least the second position, the cleaning members engage the agitator, such as by engaging the friction surfaces, to remove debris. Agitator and cleaning members may be incorporated into a cleaning head having an inlet nozzle and a chamber in which the agitator rotates, and there may be an activation mechanism using, for example, a resilient member to move the cleaning members. An overload protection device may be provided, and may adjust its sensitivity depending on whether the cleaning devices are in the first or second position.

20 Claims, 10 Drawing Sheets

(51) Int. Cl.

| | |
|---|---|
| ***A47L 11/32*** | (2006.01) |
| ***A47L 9/28*** | (2006.01) |
| ***A47L 11/40*** | (2006.01) |
| ***A46B 13/00*** | (2006.01) |
| *A47L 9/04* | (2006.01) |

(52) U.S. Cl.

CPC ..... *A47L 9/2889* (2013.01); *A47L 11/4011* (2013.01); *A47L 11/4041* (2013.01); *A47L 9/0411* (2013.01)

(56) References Cited

U.S. PATENT DOCUMENTS

| | | | |
|---|---|---|---|
| 1,231,077 | A | 6/1917 | Scheffler |
| 1,268,963 | A | 6/1918 | Gray |
| 1,412,420 | A | 4/1922 | Polansky |
| 1,757,461 | A | 5/1930 | Losey |
| 1,813,325 | A | 7/1931 | Smith |
| 1,820,350 | A | 8/1931 | Dance |
| 1,907,692 | A | 5/1933 | White |
| 1,965,614 | A | 7/1934 | Sellers |
| 1,999,696 | A | 4/1935 | Kitto |
| 2,032,345 | A | 3/1936 | Cranon |
| 2,625,698 | A | 1/1953 | De Kadt |
| 2,642,601 | A | 6/1953 | Saffioti |
| 2,642,617 | A | 6/1953 | Lilly |
| 2,663,045 | A | 12/1953 | Conway |
| 2,733,000 | A | 1/1956 | Sparklin |
| 2,741,785 | A | 4/1956 | Siebert |
| 2,789,306 | A | 4/1957 | Kath |
| 2,904,818 | A | 9/1959 | Sheahan |
| 2,960,714 | A | 11/1960 | Senne |
| 2,975,450 | A | 3/1961 | Williams |
| 3,470,575 | A | 10/1969 | Larson et al. |
| 3,536,977 | A | 10/1970 | Porter |
| 3,683,444 | A | 8/1972 | Schaefer et al. |
| 3,722,018 | A | 3/1973 | Fisher |
| 3,862,467 | A | 1/1975 | Krickovich |
| 3,863,285 | A | 2/1975 | Hukuba |
| 4,020,526 | A | 5/1977 | Johansson |
| 4,084,283 | A | 4/1978 | Rosendall |
| 4,171,554 | A | 10/1979 | Tschudy |
| 4,173,054 | A | 11/1979 | Ando |
| 4,193,710 | A | 3/1980 | Pietrowski |
| 4,209,872 | A | 7/1980 | Maier |
| 4,317,253 | A | 3/1982 | Gut |
| 4,352,221 | A | 10/1982 | Revells et al. |
| 4,370,690 | A | 1/1983 | Baker |
| 4,370,777 | A | 2/1983 | Woerwag |
| 4,372,004 | A | 2/1983 | Vermillion |
| 4,373,228 | A | 2/1983 | Dyson et al. |
| 4,398,231 | A | 8/1983 | Currence |
| 4,426,751 | A | 1/1984 | Nordeen |
| 4,573,235 | A | 3/1986 | Baird, Sr. |
| 4,654,924 | A | 4/1987 | Getz et al. |
| 4,702,122 | A | 10/1987 | Richard |
| 4,802,254 | A | 2/1989 | Lahndorff et al. |
| 4,847,944 | A | 7/1989 | Lackner |
| 4,875,246 | A | 10/1989 | MacGregor |
| 4,920,605 | A | 5/1990 | Takashima |
| 4,953,253 | A | 9/1990 | Fukuda |
| 4,989,293 | A | 2/1991 | Bashyam |
| 5,075,922 | A | 12/1991 | Tsuchida et al. |
| 5,115,538 | A | 5/1992 | Cochran et al. |
| 5,121,592 | A | 6/1992 | Jertson |
| 5,203,047 | A | 4/1993 | Lynn |
| 5,243,732 | A | 9/1993 | Koharagi et al. |
| 5,287,581 | A | 2/1994 | Lo |
| 5,394,588 | A | 3/1995 | Kweon et al. |
| 5,452,490 | A | 9/1995 | Brundula et al. |
| 5,482,562 | A | 1/1996 | Abernathy |
| 5,657,503 | A | 8/1997 | Caruso |
| 5,657,504 | A | 8/1997 | Khoury |
| 5,698,957 | A | 12/1997 | Sowada |
| 5,974,975 | A | 11/1999 | Seefried |
| 6,042,656 | A | 3/2000 | Knutson |
| 6,131,238 | A | 10/2000 | Weber et al. |
| 6,170,119 | B1 | 1/2001 | Conrad et al. |
| 6,253,414 | B1 | 7/2001 | Bradd |
| 6,266,838 | B1 | 7/2001 | Caruso |
| 6,282,749 | B1 | 9/2001 | Tajima |
| 6,286,180 | B1 | 9/2001 | Kasper et al. |
| 6,351,872 | B1 | 3/2002 | McCormick |
| 6,367,120 | B2 | 4/2002 | Beauchamp |
| 6,502,277 | B1 | 1/2003 | Petersson et al. |
| 6,539,575 | B1 | 4/2003 | Cohen |
| 6,539,577 | B1 | 4/2003 | Okuda et al. |
| 6,605,156 | B1 | 8/2003 | Clark |
| 6,810,559 | B2 | 11/2004 | Mertes et al. |
| 6,883,201 | B2 | 4/2005 | Jones et al. |
| 6,892,420 | B1 | 5/2005 | Haan et al. |
| 7,143,461 | B2 | 12/2006 | Spooner |
| 7,159,276 | B2 | 1/2007 | Omoto et al. |
| 7,163,568 | B2 | 1/2007 | Sepke et al. |
| 7,171,723 | B2 * | 2/2007 | Kobayashi ..... A47L 9/04 15/325 |
| 7,228,593 | B2 | 6/2007 | Conrad |
| 7,237,298 | B2 | 7/2007 | Reindie et al. |
| 7,293,326 | B2 | 11/2007 | Hawkins et al. |
| 7,731,618 | B2 | 6/2010 | Burlington et al. |
| 8,087,117 | B2 | 1/2012 | Kapoor et al. |
| 8,418,303 | B2 | 4/2013 | Kapoor et al. |
| 8,601,643 | B2 | 12/2013 | Eriksson |
| 8,671,515 | B2 | 3/2014 | Eriksson |
| 2002/0007528 | A1 | 1/2002 | Beauchamp |
| 2004/0172769 | A1 | 9/2004 | Giddings |
| 2004/0244140 | A1 | 12/2004 | Joo |
| 2005/0015916 | A1 | 1/2005 | Orubor |
| 2005/0015922 | A1 | 1/2005 | Lim et al. |
| 2005/0091788 | A1 | 5/2005 | Forsberg et al. |
| 2006/0037170 | A1 | 2/2006 | Shimizu |
| 2006/0162121 | A1 * | 7/2006 | Naito ..... A47L 9/02 15/416 |
| 2006/0272122 | A1 | 12/2006 | Butler et al. |
| 2006/0288517 | A1 | 12/2006 | Oh |
| 2008/0052846 | A1 | 3/2008 | Kapoor |
| 2009/0229075 | A1 | 9/2009 | Eriksson |
| 2010/0205768 | A1 | 8/2010 | Oh |
| 2010/0313912 | A1 | 12/2010 | Han |
| 2011/0035900 | A1 | 2/2011 | Chae |
| 2012/0013907 | A1 | 1/2012 | Jung |
| 2013/0008469 | A1 | 1/2013 | Yun |
| 2013/0042429 | A1 | 2/2013 | Misumi |
| 2013/0192021 | A1 | 8/2013 | Eriksson |
| 2013/0192023 | A1 | 8/2013 | Eriksson |
| 2013/0192024 | A1 | 8/2013 | Eriksson |
| 2013/0198995 | A1 | 8/2013 | Eriksson |
| 2014/0259521 | A1 | 9/2014 | Kowalski |
| 2014/0304941 | A1 | 10/2014 | Eriksson |
| 2014/0331446 | A1 | 11/2014 | Eriksson |
| 2014/0352104 | A1 | 12/2014 | Eriksson |
| 2014/0359968 | A1 | 12/2014 | Eriksson |
| 2014/0366300 | A1 | 12/2014 | Eriksson |

FOREIGN PATENT DOCUMENTS

| | | | |
|---|---|---|---|
| CN | 1816301 | | 8/2006 |
| CN | 1883354 | | 12/2006 |
| CN | 101686783 | | 3/2010 |
| CN | 101984742 | | 3/2011 |
| CN | 102334943 | | 2/2012 |
| EP | 649625 | A2 | 4/1995 |
| EP | 1415583 | A1 | 5/2004 |
| EP | 1442693 | | 8/2004 |
| EP | 1642520 | A1 | 4/2006 |
| EP | 1994869 | | 11/2008 |
| EP | 2253258 | | 11/2010 |
| EP | 2273906 | | 1/2011 |
| EP | 2543301 | | 1/2013 |
| FR | 1068296 | | 6/1954 |
| FR | 2855742 | | 12/2004 |
| GB | 2000963 | | 1/1979 |
| GB | 2231778 | | 11/1990 |
| JP | 5305044 | | 11/1919 |

(56) References Cited

FOREIGN PATENT DOCUMENTS

| | | |
|---|---|---|
| JP | 4944560 | 4/1974 |
| JP | 50114057 | 9/1975 |
| JP | 5095868 | 4/1993 |
| JP | 05103740 | 4/1993 |
| JP | 5305044 | 11/1993 |
| JP | 0686743 | 3/1994 |
| JP | 6086743 | 3/1994 |
| JP | 0856877 | 3/1996 |
| JP | 2003047577 | 2/2003 |
| JP | 2005160578 | 6/2005 |
| JP | 2005211426 | 8/2005 |
| JP | 2008278947 | 11/2008 |
| WO | 9210967 | 7/1992 |
| WO | 2008099583 | 8/2008 |
| WO | 2009117383 | 9/2009 |
| WO | 2010041184 | 4/2010 |
| WO | 2013060365 | 5/2013 |
| WO | 2013060879 | 5/2013 |
| WO | 2013060880 | 5/2013 |
| WO | 2013113395 | 8/2013 |
| WO | 2014094869 | 6/2014 |
| WO | 2014177216 | 11/2014 |

OTHER PUBLICATIONS

Non-Final Office Action mailed Apr. 16, 2015 for U.S. Appl. No. 14/354,460.
Notice of Allowance mailed Apr. 24, 2015 for U.S. Appl. No. 13/838,035.
Entire patent prosecution history of U.S. Appl. No. 14/702,034, filed, May 1, 2015, entitled, "Cleaning Nozzle for a Vacuum Cleaner."
Entire patent prosecution history of U.S. Appl. No. 14/651,059, filed Jun. 10, 2015, entitled, "Cleaning Arrangement for a Rotatable Member of a Vacuum Cleaner, Cleaner Nozzle, Vacuum Cleaner and Cleaning Unit."
Entire patent prosecution history of U.S. Appl. No. 14/702,034, filed May 1, 2015, entitled, "Cleaning Nozzle Fora Vacuum Cleaner."
Entire patent prosecution history of U.S. Appl. No. 14/730,833, filed Jun. 4, 2015, entitled, "Vacuum Cleaner Agitator Cleaner With Agitator Lifting Mechanism."
Office Action mailed May 20, 2015 for U.S. Appl. No. 13/835,691.
Notice of Allowance mailed Jun. 24, 2015 for U.S. Appl. No. 13/826,855.
Office Action mailed Jul. 7, 2015 for U.S. Appl. No. 13/826,934.
International Search Report for PCT International Application No. PCT/EP2011/068743 dated Jun. 14, 2012.
International Search Report for PCT International Application No. PCT/EP2012/051773 dated Sep. 17, 2012.
International Search Report for PCT International Application No. PCT/EP2012/071318 dated Jan. 3, 2013.
International Search Report for PCT International Application No. PCT/EP2012/071319 dated Dec. 11, 2012.
Entire patent prosecution history of U.S. Appl. No. 14/467,697, filed Aug. 25, 2014, entitled, "Actuator Mechanism for a Brushroll Cleaner."
Entire patent prosecution history of U.S. Appl. No. 13/826,855, filed Mar. 14, 2013, entitled, "Brushroll Cleaning Feature With Overload Protection During Cleaning."
Entire patent prosecution history of U.S. Appl. No. 13/826,934, filed Mar. 14, 2013, entitled, "Automated Brushroll Cleaning."
Entire patent prosecution history of U.S. Appl. No. 13/835,691, filed Mar. 15, 2013, entitled, "Vacuum Cleaner Agitator Cleaner With Power Control."
Entire patent prosecution history of U.S. Appl. No. 14/462,956, filed Aug. 19, 2014, entitled, "Vacuum Cleaner Brushroll Cleaner Configuration."
Entire patent prosecution history of U.S. Appl. No. 13/838,035, filed Mar. 15, 2013, entitled, "Vacuum Cleaner Agitator Cleaner With Brushroll Lifting Mechanism."
Entire patent prosecution history of U.S. Appl. No. 13/826,400, filed Mar. 14, 2013, entitled, "Brushroll Cleaning Feature With Resilient Linkage to Regulate User-Applied Force," now U.S. Pat. No. 8,671,515, issued Mar. 18, 2014.
Entire patent prosecution history of U.S. Appl. No. 12/405,761, filed Mar. 17, 2009, entitled, "Agitator With Cleaning Features," now U.S. Pat. No. 8,601,643, issued Dec. 10, 2013.
Entire patent prosecution history of U.S. Appl. No. 14/374,119, filed Aug. 25, 2014, entitled, "Cleaning Arrangement for a Nozzle of a Vacuum Cleaner."
Entire patent prosecution history of U.S. Appl. No. 14/354,460, filed Jun. 19, 2014, entitled, "Cleaning Nozzle for a Vacuum Cleaner."
Entire patent prosecution history of U.S. Appl. No. 14/354,449, filed Apr. 25, 2014, entitled, "Cleaning Nozzle for a Vacuum Cleaner."
Entire patent prosecution history of U.S. Appl. No. 14/354,466, filed Apr. 25, 2014, entitled, "Cleaning Nozzle for a Vacuum Cleaner."
International Search Report and Written Opinion for International Application No. PCT/IB2014/001050, mailed Oct. 28, 2014.
International Search Report and Written Opinion for International Application No. PCT/IB2014/001256, mailed Oct. 28, 2014.
Office Action for Application No. 200980110915.5 dated Feb. 4, 2013 (with English Translation), The State Intellectual Property Office of China.
Supplemental European Search Report for EP09721677 dated Oct. 30, 2012.
International Search Report for PCT Application No. PCT/US2009/037348 dated May 14, 2009.
European Search Report for EP 09 72 1677, Oct. 30, 2012.
Chinese Office Action issued Jul. 1, 2015 for Chinese Application No. 201310485330.X, including English language translation.
Chinese Office Action issued Jul. 14, 2015 for Chinese Application No. 201310479507.5, including English language translation.
Chinese Office Action issued Jul. 3, 2015 for Chinese Application No. 201310485943.3, including English language translation.
Chinese Office Action issued Jun. 30, 2015 for Chinese Application No. 201310485447.8, including English language translation.
International Preliminary Report on Patentability for International Application No. PCT/IB2014/001050 mailed Sep. 15, 2015.
International Preliminary Report on Patentability for International Application No. PCT/IB2014/001256 mailed Sep. 15, 2015.
Notice of Allowance mailed Oct. 9, 2015 for U.S. Appl. No. 14/354,460.
Notice of Allowance mailed Oct. 16, 2015 for U.S. Appl. No. 13/835,691.
Final Office Action mailed Nov. 30, 2015 for U.S. Appl. No. 13/826,934.
Notice of Allowance mailed Dec. 15, 2015 for U.S. Appl. No. 13/835,691.
Notice of Allowance mailed Dec. 23, 2015 for U.S. Appl. No. 14/354,460.
International Search Report and Written Opinion for International Application No. PCT/IB2015/001873, dated Feb. 4, 2016.
Notice of Allowance mailed Feb. 11, 2016 for U.S. Appl. No. 13/826,934.
Japanese Office Action dated Dec. 15, 2015 for Japanese Application No. 2014-555092 with translation.
Chinese Office Action dated Nov. 27, 2015 for Chinese Application No. 201280068532.8 with translation.

* cited by examiner

BRUSHROLL CLEANING FEATURE WITH SPACED BRUSHES AND FRICTION SURFACES TO PREVENT CONTACT

FIELD OF THE INVENTION

The present invention relates generally to a cleaning device and, more specifically, to an agitator having features for removing dirt and debris from the agitator.

BACKGROUND OF THE INVENTION

It is well known in the art of cleaning devices to use agitators to clean surfaces such as carpets, upholstery, and bare floors. These agitators can function in a variety of ways and appear in many forms. One typical embodiment of an agitator is a tube that rotates around its longitudinal axis and has one or more features that agitate the surface as it rotates. Such features typically include one or more bristle tufts, flexible flaps, bumps, and so on. The agitator moves or dislodges dirt from the surface, making it easier to collect by the cleaning device. Agitators are useful in a variety of cleaning devices including vacuum cleaners, sweepers, wet extractors, and so on. In a sweeper, the agitator typically moves or throws the dirt directly into a receptacle. In a vacuum cleaner or similar device, the dirt may be entrained in an airflow generated by a vacuum within the cleaning device and thereby conveyed to a filter bag, cyclone separator or other kind of dirt collection device in the vacuum cleaner. U.S. Pat. No. 4,372,004, which reference is incorporated herein, provides an example of such an agitator.

SUMMARY OF THE INVENTION

In one exemplary aspect, the present invention may provide a cleaning device agitator system having an agitator and one or more cleaning members. The agitator includes a spindle having a first end, a second end, and a longitudinal axis extending between the first end and the second end. One or more agitating devices project from the spindle to a first radial height, and one or more friction surfaces project from the spindle to a second radial height. The one or more cleaning members are positioned adjacent at least a portion of the agitator. The cleaning members are adapted to move between a first position in which the cleaning members do not engage the friction surfaces, and a second position in which the cleaning members engage the friction surfaces to clean debris from the agitator.

In another exemplary aspect, the present invention may provide a cleaning head for a cleaning device. The cleaning head includes an inlet nozzle, an agitator chamber adjacent and in fluid communication with the inlet nozzle, an agitator, one or more cleaning members adjacent at least a portion of the agitator, and an engagement mechanism. The agitator includes a spindle having a first end, a second end, and a longitudinal axis extending between the first end and the second end. The spindle is rotatably mounted in the agitator chamber. One or more agitating devices project from the spindle to a first radial height, and are of sufficient radial height to extend through the inlet nozzle during rotation of the spindle. One or more friction surfaces project from the spindle to a second radial height. The activation mechanism is adapted to move the one or more cleaning members between a first position in which the one or more cleaning members do not engage the one or more friction surfaces, and a second position in which the one or more cleaning members engage the one or more friction surfaces to clean debris from the agitator.

In another exemplary aspect, the present invention may provide a rotary cleaner having an agitator, a motor adapted to apply a torque to the agitator to rotate the agitator about a rotating axis, one or more cleaning members positioned adjacent at least a portion of the agitator, and an overload protection device adapted to terminate the application of torque to the agitator when the torque exceeds a threshold value. The agitator includes a spindle having a first end, a second end, and a longitudinal axis extending between the first end and the second end, and one or more agitating devices projecting from the spindle to a first radial height. The one or more cleaning members are movable between a first position in which the one or more cleaning members are spaced a first distance from a rotating axis of the spindle, and a second position in which the one or more cleaning members are spaced a second distance from the rotating axis. The one or more cleaning members clean debris from the agitator in at least the second position.

BRIEF DESCRIPTION OF THE DRAWINGS

Various exemplary aspects of the invention will be readily understood from the following detailed description and the accompanying drawings, which are exemplary only, and not intended to limit the invention.

DETAILED DESCRIPTION OF THE PREFERRED EMBODIMENTS

Figure 1:
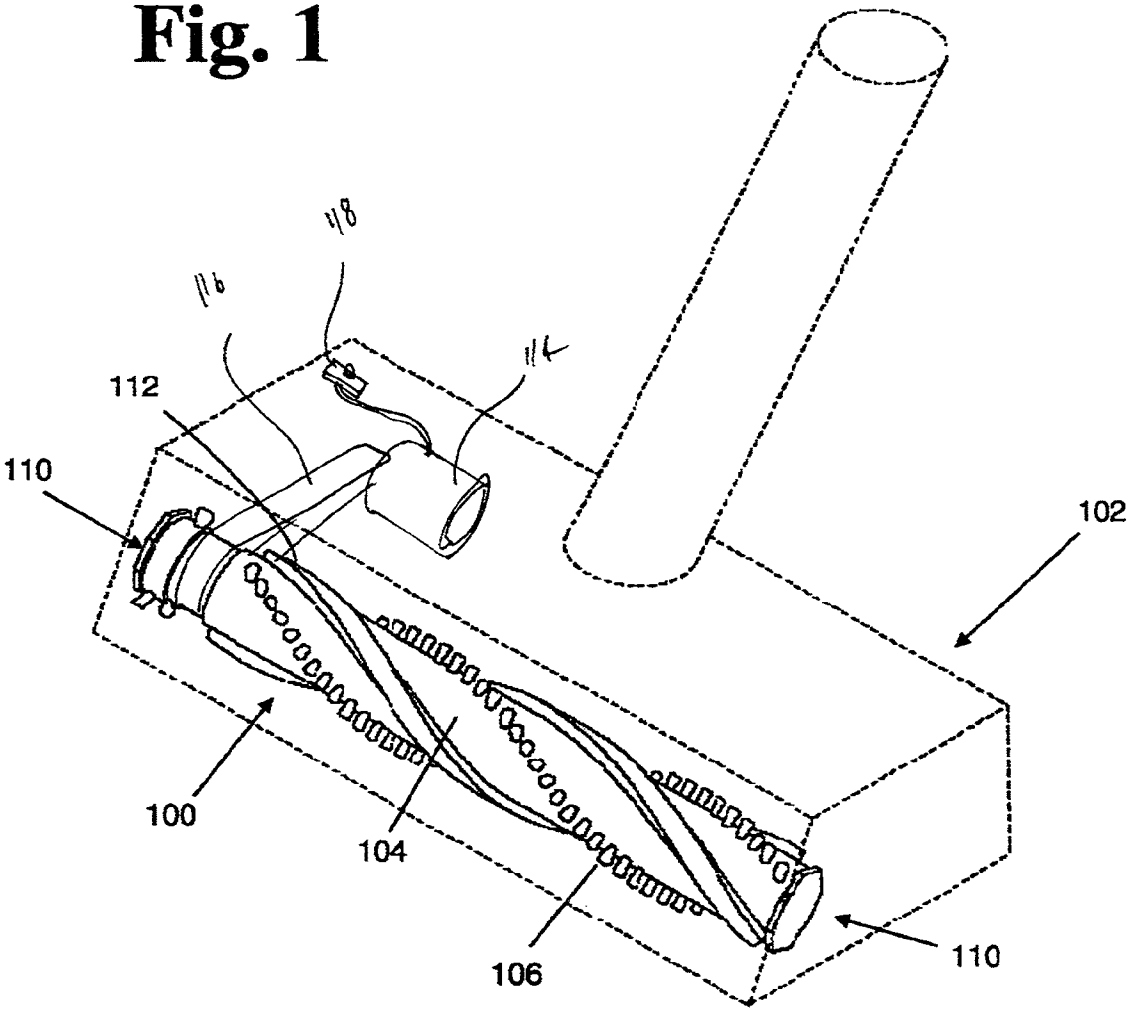
FIG. 1 is a perspective view of an agitator having an exemplary agitator cleaning feature.

It has been found that rotating agitators used in vacuum cleaners, floor sweepers and the like can collect a significant amount of various kinds of dirt and debris on the agitator itself. For example, the debris may include human and animal hairs, strings, threads, carpet fibers and other elongated objects that wrap around or otherwise cling to the agitator. It has also been found that accumulated debris can reduce the performance of the agitator in a variety of ways. For example, debris may cover the agitation bristles and diminish the agitator's ability to agitate a surface. Further, debris on the agitator may impede the rotation of the agitator by wrapping around the axle or by creating additional friction with the cleaning head. If not removed, such debris can also accumulate on or migrate to the ends of the agitator and enter the bearing areas where they may cause binding, remove bearing lubrication, or otherwise generate high friction, excessive heat, or other undesirable conditions that can damage the bearings or mounting structure. In addition, debris collected on the agitator may create an imbalance in the agitator that may result in sound and/or vibrations when the agitator rotates.

Debris that has collected on an agitator is often difficult to remove because it has wrapped tightly around the agitator and intertwined with the bristles. Users of a cleaning device often must invert the device and remove the debris with manual tools such as knives, scissors or other implements. Manual removal can be unsanitary, time consuming and, if the user fails to follow instructions to deactivate the vacuum, may expose the user to contact with a moving agitator.

The present invention generally provides an agitator having features for removing dirt and debris from the agitator. The cleaning feature may include one or more surfaces on the agitator body and one or more cleaning members or other devices adapted to move towards the surfaces to engage to cut, abrade, strip or otherwise remove debris that has become wrapped around the agitator. Embodiments of the invention may be used with any type of cleaning device, such as upright vacuums, canister vacuums, central vacuum systems, powder or fluid extractors, or sweepers. For example, in one embodiment, shown in FIG. 1, the invention may provide an agitator 100 mounted in a cleaning head 102 for a floor sweeper or a vacuum cleaner. Such cleaning heads 102 are known in the art, and may include features such as a motor 114 to drive the agitator 100 by a belt 116 or gears or other known mechanisms, a dirt receptacle, wheels to support the cleaning head 102 at a fixed or variable height above the floor, one or more air passages that lead to a vacuum source, and so on. Non-limiting examples of various devices with which an agitator may be used are shown in U.S. Publication No. 2006/0021184, and U.S. Pat. Nos. 6,502,277 and 7,163,568. The foregoing references are incorporated herein. The motor 114 may drive a vacuum fan or impeller, or it may be dedicated to driving only the agitator 100.

As shown in FIG. 1, the exemplary agitator 100 may include a tubular spindle 104 from which a number of agitating devices, shown as bristles 106, extend. If desired, the bristles 106 may be removable in order to allow replacement if they become worn out or damaged. In alternative embodiments, different numbers, arrangements and types of agitating devices may be used, and the agitating devices may be mounted in any number of known ways. For example, one or more of the bristles 106 may be replaced by one or more beater bars (provided either as separate parts or formed as part of the spindle 104), flaps, or other agitators. Variations on the number, arrangement, and kind of agitating device will be apparent to persons of ordinary skill in the art in view of the present disclosure.

The exemplary agitator 100 mounts in the cleaning head 102 by one or more bearings, bushings or similar devices. The agitator 100 may be mounted at each end, but it also may be mounted by intermediate bearings or bushings located along its length. In the exemplary embodiment, the agitator 100 mounts to the cleaning head 102 by a pair of mounting assemblies 110 that permit the agitator to rotate relative to the cleaning head 102. Such mounting assemblies 110 are known in the art.

The exemplary agitator 100 is also fitted with one or more friction surfaces 112 that protrude radially from the spindle 104. The exemplary agitator 100 may have two friction surfaces 112 that are formed as helical ridges that wrap around the spindle 104 and run approximately the entire length of the spindle 104. The helical arrangement of the friction surfaces 112 distributes the friction surfaces 112 around the circumference and along the length of the rotatable agitator 100. The friction surface 112 may be a separate part that is attached to the spindle 104 by screws or other attachment mechanisms, such as tongue-and-groove fitment, adhesives, and so on. Alternatively, the frictions surfaces 112 may be formed or molded as part of the spindle 104, and have a radial height that is greater than the radial height of the remaining portions of the spindle 104 from which the bristles 106 or other agitating devices project.

Figure 2A:
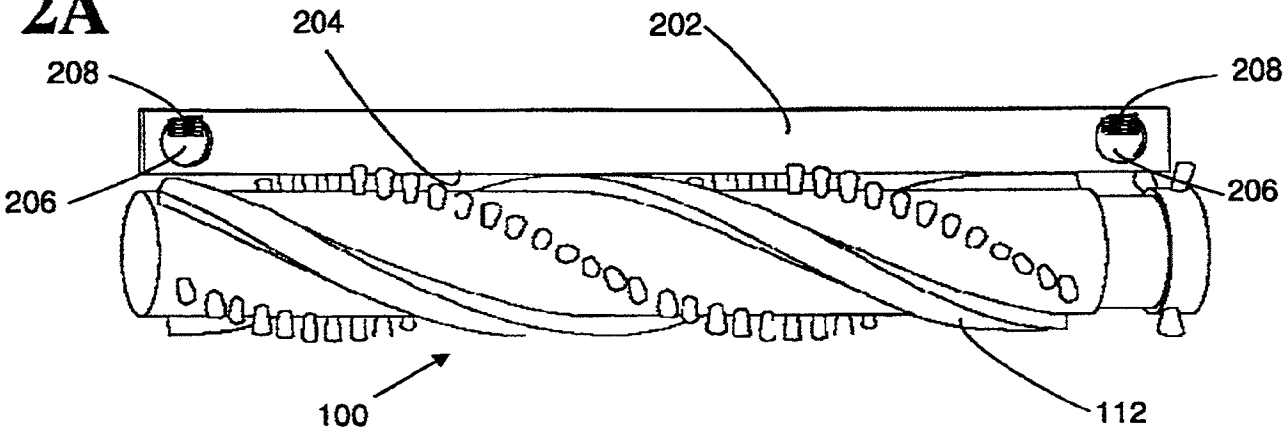
FIG. 2A is a perspective view of the agitator of FIG. 1, shown with a cleaning member engaged with the agitator.
Figure 2B:
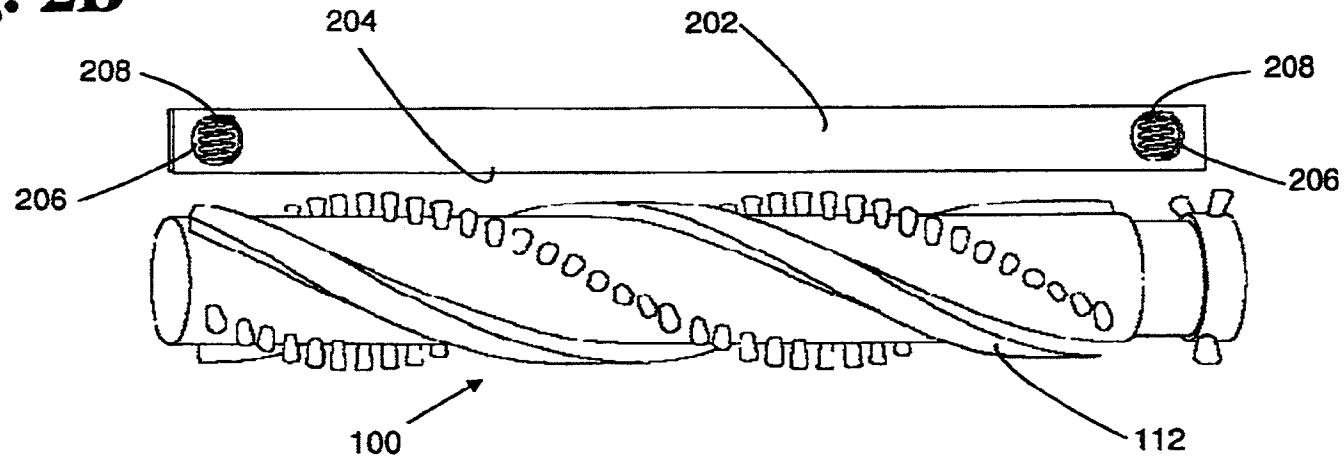
FIG. 2B is a perspective view of the agitator of FIG. 1, shown with a cleaning member disengaged from the agitator.

As shown in FIGS. 2A and 2B, the exemplary agitator 100 may have a cleaning member such as a blade 202 arranged parallel to the agitator 100 and extending the length of the friction surfaces 112. As shown in FIG. 2A, the blade 202 may be moved adjacent the friction surfaces 112 where it can contact or almost contact the friction surfaces 112. As the agitator 100 rotates, a bottom edge 204 of the blade 202 pinches and cuts debris and other material between the bottom edge 204 and the friction surfaces 112. In doing so, the blade 202 and friction surfaces 112 loosen or sever debris from the agitator 100, including elongated debris wrapped around the circumference of the agitator 100. At any one time, the blade 202 in the exemplary embodiment may be adjacent the friction surface 112 at one or more positions along the length of the agitator 100. In the embodiment of FIGS. 2A and 2B, contact generally occurs at two points at any given agitator orientation. As the agitator 100 rotates, the points of engagement between the helical friction surface 112 and the blade 202 move laterally over the length of the agitator 100 due to the helical shape of the friction surface 112. The rotating helical friction surface 112 therefore achieves a cutting pattern that loosens debris from the entire length of the agitator 100 as the agitator rotates. The loosening of the debris makes it easier for the vacuum or other collection mechanism to remove the debris from the agitator 100.

The blade 202 may remain in the operating position shown in FIG. 2A at all times, or it may be selectively activated to move it into and out of the agitator cleaning position. FIG. 2B shows the agitator cleaning feature in a deactivated state where the blade 202 retracts from the agitator 100. Any suitable mechanism may be provided for moving the blade 202 towards and away from the agitator 100. In the exemplary embodiment, the blade 202 has apertures 206 at opposing ends of the blade 202. Springs 208 fit within these apertures 206 and press against a housing member (304 in FIGS. 3A and 3B) to bias the blade 202 away from the agitator 100. The springs 208 also may help keep the blade 202 axially balanced along the length of the friction surfaces 112. The manner in which the springs 208 perform this function is described below regarding FIGS. 3A and 3B.

Figure 3B:
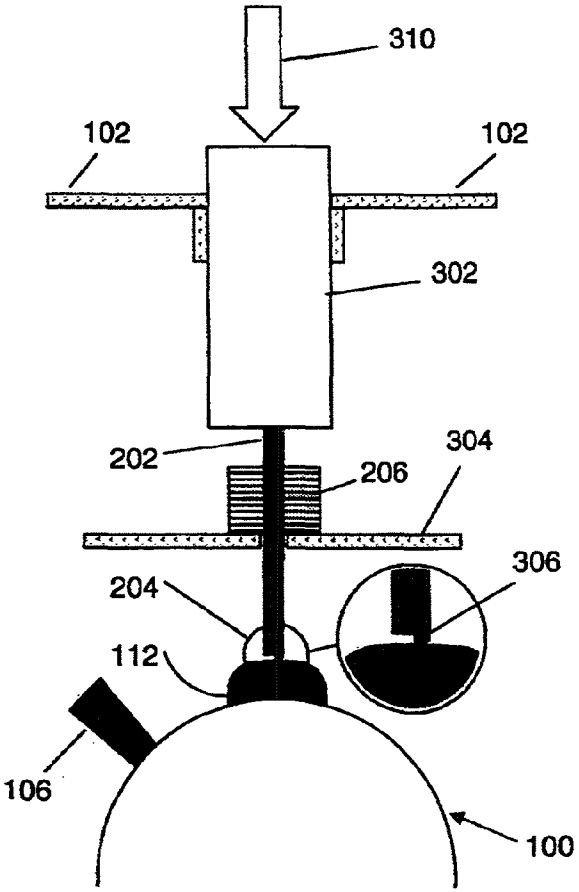
FIG. 3B is another end view of the agitator of FIGS. 1 and 3A, showing the agitator in a rotated position relative to the view of FIG. 3A.
Figure 3A:
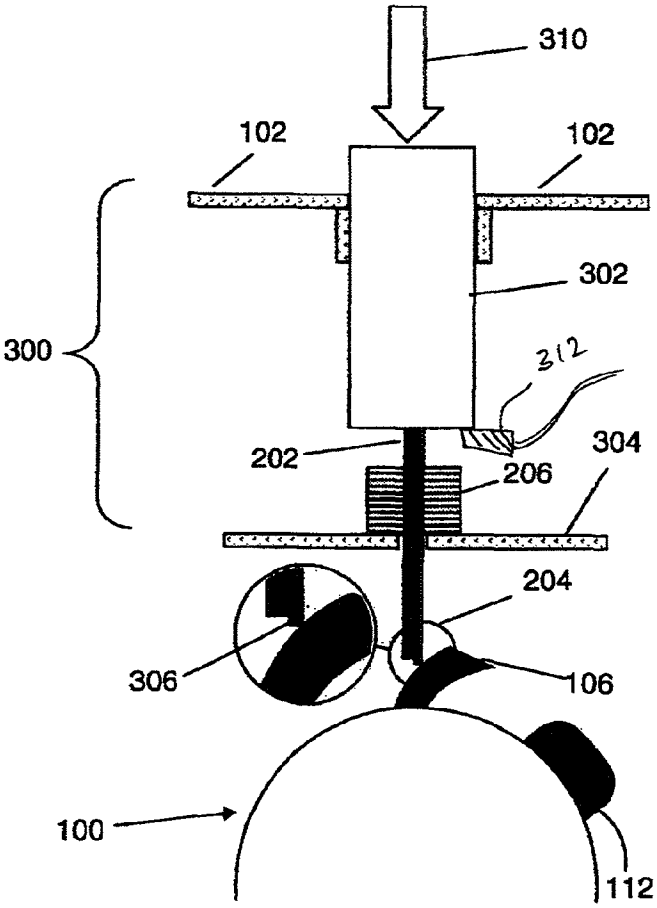
FIG. 3A is an end view of the agitator of FIG. 1.

FIGS. 3A and 3B illustrate an exemplary embodiment of an activation mechanism 300 as it appears in the activated state. The activation mechanism 300 comprises a button 302, a support surface 304, the springs 206, and a top surface of the cleaner head 102. The user may apply a downward force 310 on the button 302, such as with the user's foot, which forces the blade 202 downward through the support surface 304. The blade 202 is then in position adjacent the friction surface 112. The springs 206 may be located on either side of the button 302 so that the button 302 acts as a central fulcrum across which the forces between the blade 202 and the frictions surfaces 112 can balance to prevent too much force from being transmitted to either end of the blade 202.

The downward movement of the blade 202 compresses the spring 206 against the support surface 304, and therefore continued downward force 310 is necessary to keep the blade 202 adjacent the friction surface 112. If desired, a lock or other mechanism may be provided to hold the blade in this position without requiring the continued application of force on the button 302. When the user ceases to apply force 310, the springs 206 move the blade 202 upwards and away from the agitator 100 and out of contact with the agitator bristles 106, thus deactivating the cleaning mechanism.

As shown in FIGS. 3A and 3B, the blade 202 may interact with both the bristles 106 and the friction surface 112. As best shown in FIG. 3B, the bristles 106 extend a first distance from the rotational axis of the agitator 100 (this distance is referred to herein as the radial height), and the friction surfaces 112 extend a second distance from the rotational axis of the agitator 100. The radial height of the bristles 106 preferably is greater than the radial height of the friction surfaces 112, but this is not required in all embodiments. For example, in some embodiments, the friction surfaces 112 may act as beater bars that have a similar or the same radial height as the bristles.

In the exemplary embodiment, the bristles 106 extend further from the spindle axis than the friction surfaces 112, and thus they bend as they pass beneath the blade 202. Adequate circumferential spacing between the bristles 106 and the friction surface 112 prevents the bristles 106 from being pinched between the friction surface 112 and blade 202 when they are bent over. The blade 202 may abrade the bristles 106 to some degree as it bends them over, but it has been found that such abrasion may be minimal or tolerable considering the expected lifetime of the device or the bristles. As shown in FIG. 3B, the friction surface 112 engages the blade 202, which may occur before or after the bristles 106 have passed under the blade 202. Of course, where the agitator 100 rotates continuously as the blade 202 is depressed, the bristles 106 and friction surface 112 may alternately contact the blade 202. When the blade 202 is retracted, it may move clear of both the friction surface 112 and the bristles 106, or it may remain in light contact with the bristles to continue to clean them.

It will be appreciated that excessive abrasion and impedance to the agitator's rotation may be reduced by modifying the flexibility of the bristles 106 and/or blade 202, or by changing the various dimensions of the bristles 106, blade 202 and friction surfaces 112. For example, the flexibility of the bristles 106 may be modified by changing their physical composition, by increasing the height of the bristles from the surface of the spindle 104.

FIGS. 3A and 3B also include inserts that show the exemplary blade 202 in magnified detail. The blade 202 in the exemplary embodiment comprises a 2-millimeter thick steel plate, and the bottom edge 204 of the blade 202 is milled to create a contact surface 306 that is about 0.5 millimeters thick. The narrower contact surface 306 may increase the surface pressure exerted by the blade 202 against the friction surface 112 or against particles or objects lying against the friction surface 112. Also, the contact surface 306 may be rounded on its leading edge to decrease wear on the bristles 106.

The invention can include any number of embodiments in addition to the above-described exemplary embodiment. For example, the friction surface 112 may comprise an uneven ridge or discrete bumps that extend at any suitable radial distance or distances from the longitudinal axis of the spindle 104. In some embodiments, the friction surface 112 extends a greater radial distance from the spindle 104 than the bristles 106. In other embodiments, the friction surface 112 may protrude only a short distance from the spindle 104. Further, the friction surface 112 may comprise helical ridges that are not continuous over the full length of the agitator 100. The latter arrangement may be used, for example, to enable a drive belt to contact the spindle 104 at a pulley located at an intermediate location along the spindle 104.

Figure 4:
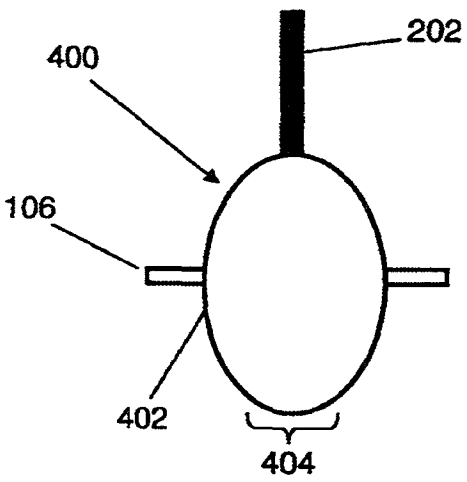
FIG. 4 is an end view of another agitator having exemplary agitator cleaning features.

While the exemplary embodiment of FIG. 1 illustrates the friction surfaces 112 as being parts that are joined to the spindle 104, in other embodiments, the friction surface(s) 112 may be integrally formed with the spindle 402. For example, FIG. 4 depicts an alternative embodiment of an agitator 400 in which the spindle 402 has an oval cross-sectional profile, rather than a typical cylindrical profile, and the distal ends of the oval profile provide friction surfaces 404 similar to the friction surface 112 of FIG. 1. Other spindle profiles may provide integrally formed friction surfaces 112 in other embodiments. As with the previous embodiment, however, the friction surfaces 404 of this embodiment provide discrete portions of the spindle that extend radially further from the remaining portions of the spindle's surface. It will be understood by persons of ordinary skill in the art that the friction surface(s) 112 can be provided in numerous other configurations to facilitate the loosening, shearing, tearing, cutting or shredding of debris from the agitator 100.

It will also be understood that other embodiments of the invention may use any suitable alternatives to the exemplary cutting blade. For example, alternative embodiments may have a number of blades. Also, while the blade 202 of FIGS. 1-4 is shown being at a right angle to the spindle 104, alternative embodiments of the blades may be disposed at various angles relative to the spindle 104. The invention also includes arrangements of multiple blades at various positions around the circumference of the agitator. In one embodiment, two blades are located on opposing sides of the agitator. An opposing blade arrangement may be helpful to create two counteracting forces on the agitator when the agitator cleaning feature activates, and thus may reduce the total amount of force exerted on the bearings and mounting assembly 110.

It will be understood that the blade 202 may comprise any resilient material, and the blade 202 need not resemble a sharpened edge or a simple planar structure. The blade 202 may comprise a variety of materials, preferably materials that are heat resistant and durable enough to generate and withstand sufficient friction to efficiently remove entangled articles. The blade 202 also may be selected or modified (such as by polishing) to reduce or minimize the amount of wear on the bristles 106. The invention may also use an abrasive surface as a cleaning member instead of a blade 202, or the blade 202 may be treated or shaped to enhance its abrasiveness. It will also be understood that the blade 202 is just one example of a cleaning member that may be used with embodiments of the invention. For example, the blade 202 comprise or be replaced by a round bar having a small or large diameter that is moved into contact with the friction surfaces.

Figure 8:
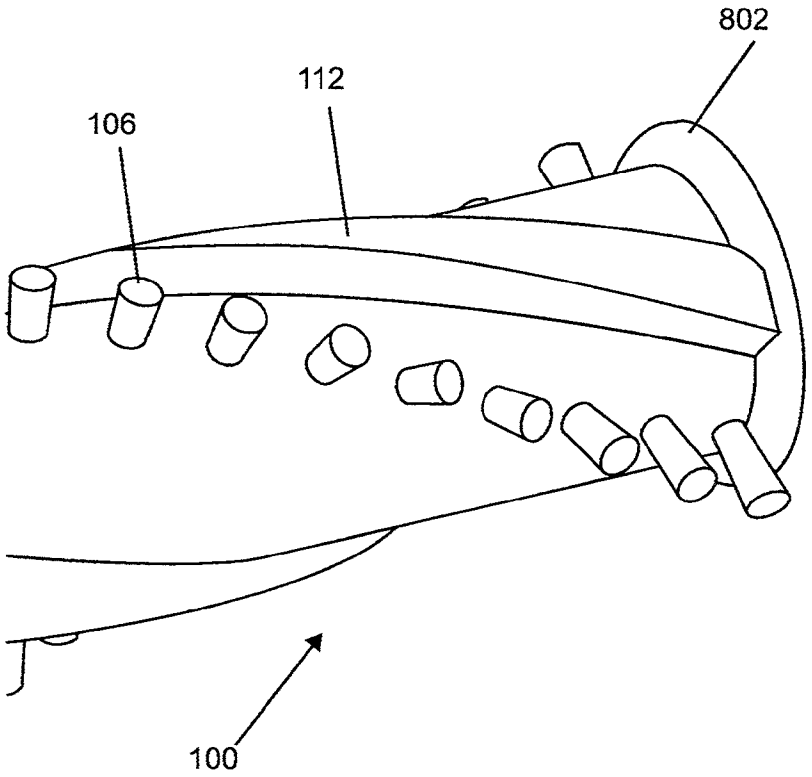
FIG. 8 is a fragmented isometric view of one end of another exemplary agitator.

It will also be understood that the geometry of the blade 202 or blades and the friction surface(s) 112 can determine the engagement pattern between the friction surface 112 and the blade 202. In the illustrated embodiment, the blade 202 and friction surface 112 are adjacent one another at at least two points, regardless of the orientation of the agitator 100, due to the fact that the friction surfaces 112 extend around the circumference of the spindle 104 in a helical pattern. This prevents the blade 202 from becoming unbalanced and tipping closer to the agitator 100 on one side of the friction surface 112 than the other. Alternatively, this may not be necessary where it is found to not cause any problems during operation. In other embodiments, rings of material may be provided around the agitator 100 to control the movement of the blade 202 towards the agitator 100. For example, as shown in FIG. 8, a ring 802 of friction surface material may be located at each end of the agitator 100, or at intermediate positions (only one ring is shown at one end of the agitator). In this embodiment, the blade 202 rides on the rings 802, preventing any imbalance along the axial length of the agitator 100. In this embodiment, constant contact between the blade 202 and the rings 802 when the blade is activated may increase wear on the rings 802, and if this is found to be a problem the rings 802 may be constructed from a more heat-resistant material. Rings 802 at the ends of the agitator 100 also may be conical or tapered to increase in diameter towards the ends of the agitator 100 to help prevent dirt and debris from passing beyond the ends of the agitator 112 and potentially contaminating the agitator mounting bearings. To further protect against bearing contamination, circumferential walls (not shown) may be provided on the housing to which the agitator 100 is mounted to surround each end rings 802, and a slot may be provided through the wall to allow the blade 202 to contact the rings 802.

The blade 202 preferably is shaped to contact the friction surface 112 along the entire length of the friction surface 112 to keep from missing spots during cleaning. For example, the blade 202 may be generally straight and the friction surface 112 may have a generally constant radial height to help ensure that they come into contact along the entire length of both the blade 202 and the friction surface 112. As noted above, the blade 202 may actually contact the friction surface 112, or it may be retained a short distance from the friction surface 112. The invention may alternatively be practiced using any variety of other engagement patterns ranging from one intermittent engagement point between the cleaning member and the friction surface to a constant swath across the entire agitator.

The engagement pattern may affect a number of aspects of the device's operation, including the thoroughness of debris reduction and the resistance created by the cleaning member to the rotation of the agitator. In some cases, a sparse engagement pattern may adequately remove debris while not excessively resisting the rotation of the agitator. In other cases, it may be preferable for the cleaning member or cleaning members to apply significant pressure to the friction surface in order to remove tightly wound debris. In some embodiments, the engagement pattern covers only a portion of the agitator's length, such as at locations where debris is likely to accumulate, or the cleaning member may be shorter than the length of the agitator, but movable along the length of the agitator to press against it where necessary to remove debris. Also, multiple cleaning members may be provided along the length of the agitator, which cleaning members can be individually operated to clean select portions of the agitator. In embodiments where the cleaning member creates greater resistance to the rotation of the agitator, the drive motor may be selected to ensure that the agitator can continue to rotate when the cleaning member is engaged. These and other embodiments will be readily apparent to persons of ordinary skill in the art in view of the present disclosure.

The relative orientation of the friction surface 112 and the cleaning member may produce a variety of physical consequences. For example, the interaction of the helically-shaped friction surface 112 in the exemplary embodiment of FIGS. 1 through 2B with the blade 202 may create a thrust load on the agitator 100. The thrust load may apply a force on the agitator 100 in one of the longitudinal directions, which may reduce bearing life at the end bearing the thrust load. While the magnitude of such a thrust load may be inconsequential and ignored, in some embodiments, the invention may include arrangements that address physical consequences such as a thrust load. One such embodiment is a friction surface 112 similar to that in FIG. 1, but in which the friction surface 112 reverses its helical wrap at the midpoint of the friction surface 112. Such an arrangement creates two opposing thrust loads and therefore neutralizes any consequential lateral force on the agitator. Alternatively, the bearing on the end of the agitator receiving the thrust load may simply be selected to bear the load for the desired agitator life cycle.

Figure 7:
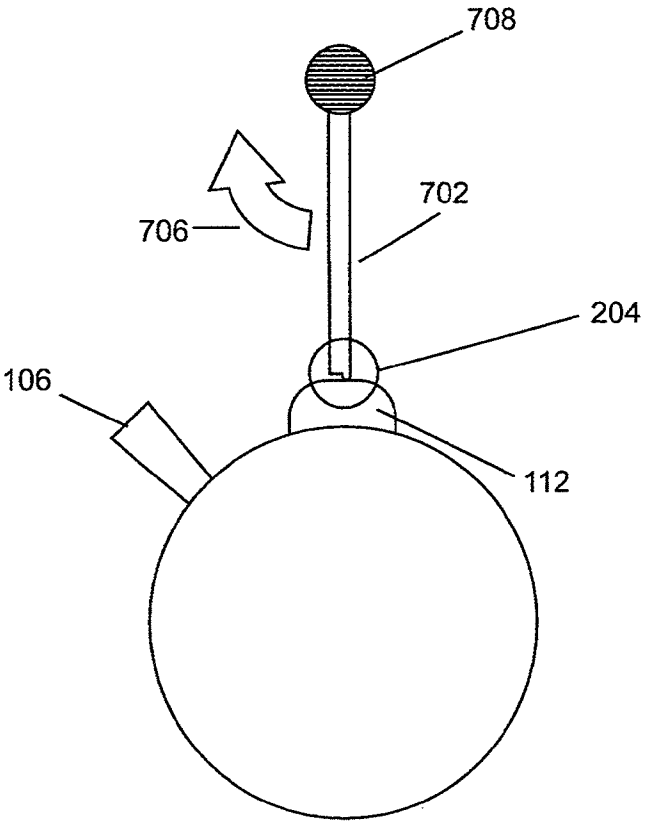
FIG. 7 is an end view of another agitator having exemplary agitator cleaning features.

As shown in FIGS. 3A-3B, the blade 202 may be moved linearly to engage the friction surfaces, but this is not required in all embodiments. For example, in the alternative exemplary embodiment of FIG. 7, a blade 702 is mounted on a pivot 708 that allows it to be pivoted into and out of engagement with the friction surface 112. When it is desired to deactivate the blade 702 it may be rotated (arrow 706) out of engagement with the agitator. If desired, a spring (not shown) may be provided to bias the blade 702 towards or away from the agitator, and other features may be used as desired. In other exemplary embodiments, the blade may be adapted to avoid contact with the bristles. For example, the blade may be driven up and down by a gear mechanism that is timed to rotate with the agitator to raise the blade to clear the agitator bristles, then lower the blade to be adjacent the friction surfaces. Alternatively, the blade may be shaped as a helical member that rotates in the opposite direction as the agitator. It will be further understood that, in other embodiments, the blade or other cleaning member may be selectively activated and deactivated using any other suitable mechanism or method. For instance, a switch-activated electrical solenoid might be energized and apply pressure to the blade 202 (or a linkage or other mechanism operatively connected to the blade) to move the blade 202 into engagement with the friction surface 112.

Figure 5:
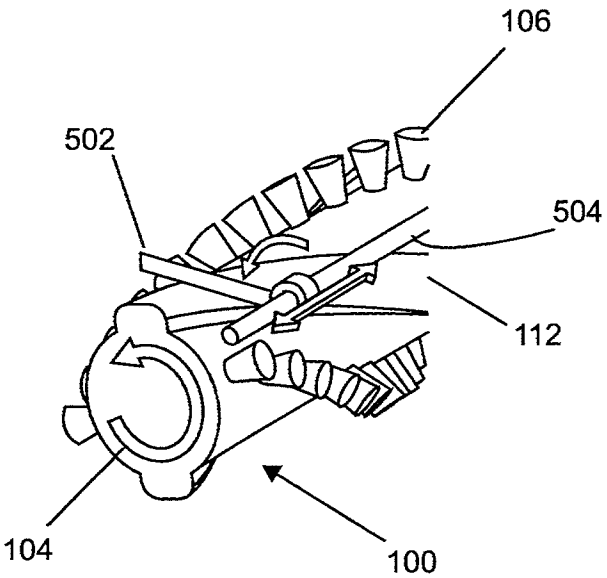
FIG. 5 is a partial perspective view of another agitator having exemplary agitator cleaning features and a cleaning member assembly.

FIG. 5 depicts another exemplary embodiment of an agitator 100 with an agitator cleaning feature. In this embodiment, the cleaning member comprises a blade 502 adapted to traverse the length of the agitator 100 while generally remaining adjacent a corresponding friction surface 112. The blade 502 operates similarly to a lathe, and removes debris from the entire length of the agitator 100. The blade 502 in this embodiment is disposed adjacent the spindle 104 and can be oriented generally perpendicular to the longitudinal axis of the spindle 104. The blade 502 is therefore oriented generally parallel to the rotation of the agitator 100 and tends to pass between the bristles or through the individual fibers forming each bristle. Thus, it is expected that this embodiment will not produce excessive wear on the bristles 106. The blade 502 is mounted such that it can traverse the agitator 100 and remove debris from the length of the spindle 104. for example, the blade 502 may be mounted on a track 504 located adjacent and parallel to the agitator 100.

Figure 6B:
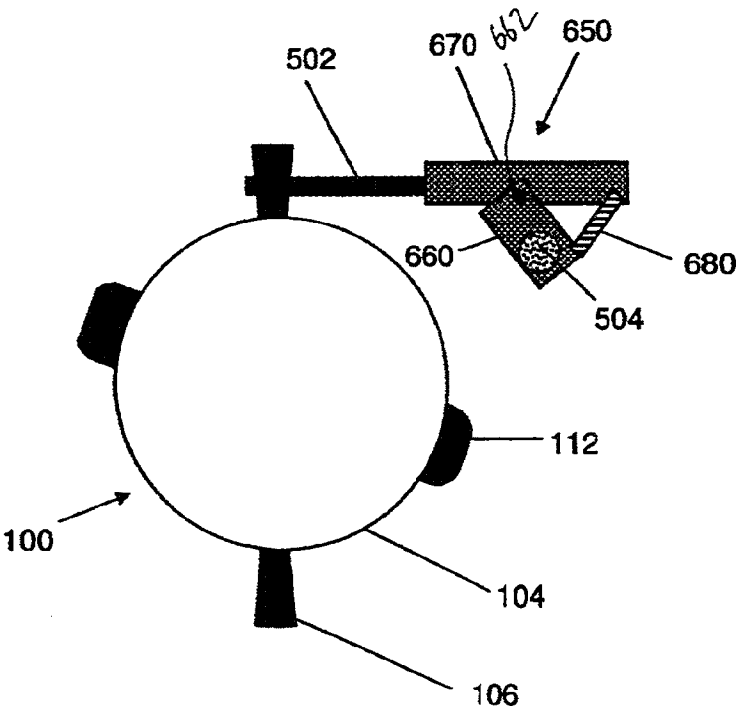
FIG. 6B is an end view of the agitator of FIGS. 5 and 6A, showing the agitator in a rotated position relative to the view of FIG. 6A.
Figure 6A:
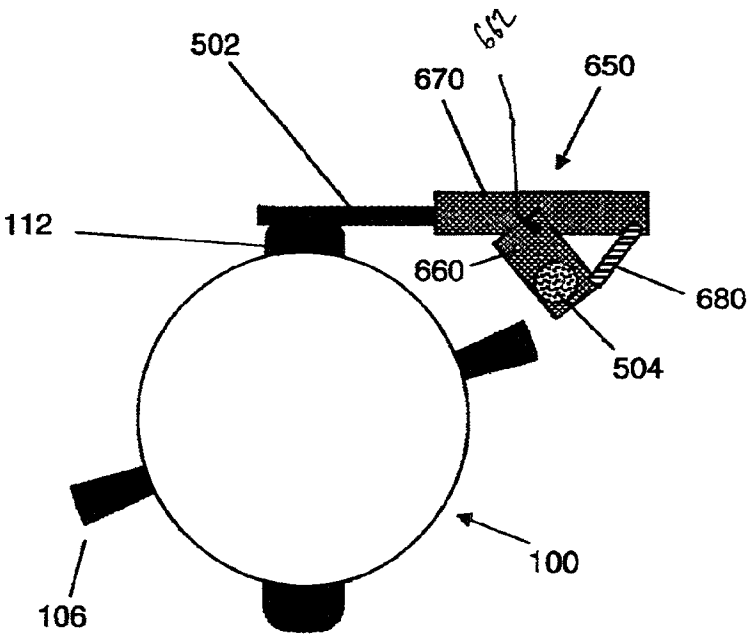
FIG. 6A is an end view of the agitator of FIG. 5.

FIGS. 6A and 6B depict the embodiment of FIG. 5 in more detail. As shown in FIG. 6A, as the agitator 100 rotates, the blade 502 removes debris from the agitator 100 by cutting the debris against the friction surface 112. When the friction surface 112 rotates past the blade 502, as shown in FIG. 6B, the blade 502 passes through the bristles 106 and does not contact the spindle 104.

FIGS. 6A and 6B also show that the blade 502 may be mounted to a blade assembly 650. The blade assembly 650 may include any features useful to position and operate the blade 502. For example, the blade assembly 650 may includes a slide 660, a blade holder 670 and a spring 680. The slide 660 mounts the blade assembly 650 on the track 504. The blade holder 670 captures the blade 502 (which may be removable and replaceable), and may pivotally connect the blade 502 to the slide 660 by a pivot pin 662. The spring 680 is positioned between the slide 660 and the blade holder 670, and provides a resilient biasing force to pivot the blade holder 670 relative to the slide 660. The angle between the slide 660 and the blade holder 670 can increase or decrease with expansion or compression of the spring 680. Thus, the spring 680 can bias the blade 502 against the friction surface 112, but allows the blade 502 to move away from the agitator 100 (by compressing the spring 680), if the blade 502 encounters an obstruction that can not be cut or cut with a single pass. While spring 680 is shown as a compression spring, the spring 680 may alternatively be in tension (i.e., the spring is extended to move the blade 502 away from the agitator 100, rather than compressed).

The blade 502 may be moved along the agitator 100 by any suitable method or means. For example, in one embodiment, the user can manually side the blade assembly 650 back and forth along the track 504. Alternatively, an electric motor may move the blade assembly 650 along the track 504. To this end, the track 504 may comprise, for example, a screw thread that engages a corresponding threaded bore through the slide 660 to move it back and forth. Alternatively, a portion of the track 504 to which the blade assembly 650 mounts may move longitudinally along the agitator 100. Other suitable methods and mechanisms for moving the blade along the agitator will be understood by persons of ordinary skill in the art in view of the present disclosure.

It will also be understood that any other suitable modifications may be made to the embodiment of FIGS. 5-6B. For example, the blade 502 may be replaced with multiple blades and the blade(s) may be at alternative or multiple angles with respect to the spindle 104. Also, any resilient material or mechanism capable of holding the blade 502 in contact with the agitator 100 may substitute the spring 680. Further, in other embodiments, the blade assembly 650 may be configured to allow the blade 502 to contact the spindle 104 at one or more locations between the friction surfaces 112 to possibly further enhance its cleaning performance. These and other variations on the embodiments disclosed herein will be readily apparent to persons of ordinary skill in the art in view of the present disclosure.

The agitator cleaning feature shown in FIGS. 5 through 6B can be activated and deactivated in any suitable way. For example, the agitator cleaning feature can be deactivated simply by ceasing to traverse the agitator 100 and remaining in one place. In an alternative embodiment, the blade 502 may be adapted to pivot away from the agitator 100 to prevent the blade from contacting the friction surface 112 and/or bristles 106. In another embodiment, the blade assembly 650 may be able to slide to a position beyond an end of the agitator 100 to deactivate the agitator cleaning feature. In still other embodiments, the agitator cleaning feature may be selectively attachable to the cleaning head 102. For example, the user may be able to snap the track 504 and blade assembly 650 onto the cleaning head 102 when it is desired to clean the agitator, and remove them when cleaning is done. Other variations will be readily apparent to persons of ordinary skill in the art.

As noted above, the agitator cleaning features described herein may be operated manually or by operation of motors or other mechanical or electrical devices. For example, the button used to operate the cleaning feature described in FIGS. 3A and 3B may be replaced by an electrically-operated solenoid or other mechanical or electromechanical system that may be operated automatically, manually by the user (such as by depressing switch to activate a solenoid, or by any combination of methods. Furthermore, embodiments of the invention may include any number of methods for selecting when to activate the agitator cleaning feature. In one embodiment, the user manually activates the feature whenever cleaning is desired. In other embodiments, the cleaning feature may be activated automatically based on a predetermined schedule or any kind of feedback or feedforward control system. For example, a microprocessor may receive data regarding the resistance to the rotation of the agitator caused by collection of debris on the agitator, and operate the cleaning feature when this resistance is perceived to be above a predetermined threshold. Still other embodiments may signal the user to activate the feature after the agitator has been operating for a predetermined length of time, or automatically perform the cleaning operation at predetermined times. Other variations of control systems will be apparent to persons of ordinary skill in the art in view of the present disclosure.

In embodiments in which the user can manually operate the cleaning feature, any suitable interface and/or control module may be used to allow the user to activate the cleaning feature. For example, electrical or mechanical buttons, levers or switches may be used, and such controls may be located anywhere on the cleaning device. For example, a control button may be provided on the handle of an upright vacuum cleaner or on the floor-engaging cleaning head. Of course, numerous variations on the foregoing embodiments will be apparent to persons of ordinary skill in the art in view of the present disclosure, and such embodiments are within the scope of the present invention.

Figure 9:
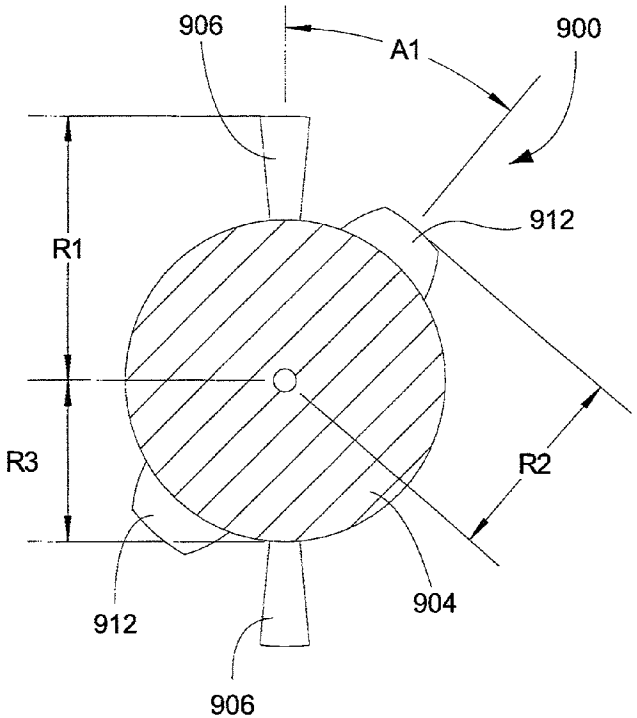
FIG. 9 is a cross-sectional view of an exemplary embodiment of an agitator.

Referring to FIG. 9, a cross-sectional view of an exemplary embodiment of an agitator 900 is shown. The agitator 900 includes friction surfaces 912, and rows of bristles 906, which are arranged in helical patterns around the agitator spindle 904, such as shown in FIG. 1. The agitator 900 in FIG. 9 is intended to rotate in a clockwise direction, but may instead rotate in a counter-clockwise direction. In this embodiment the friction surfaces 912 are located about 40 degrees in advance of the bristles 906, as shown by angle A1. FIG. 9 also illustrates the radial heights of the bristles (measurement R1) and friction surfaces (measurement R2), as well as the radius of the spindle 904 (R3). It has been found that the difference between R1 and R2 can affect the wear on the bristles caused by contact with a blade 202 or other cleaning member because the cleaning member must traverse this distance in order to contact the friction surface 912. Thus, for example, if the radial height of the bristles (R1) is significantly higher than the friction surface radial height (R2), the blade 202 will contact a greater portion of the bristles 906 when it is depressed to engage the friction surfaces 912. In one embodiment, it may be desirable for the ratio (R1-R3)/(R2-R3) to be at least about 0.4, or around 0.5.

Figure 10:
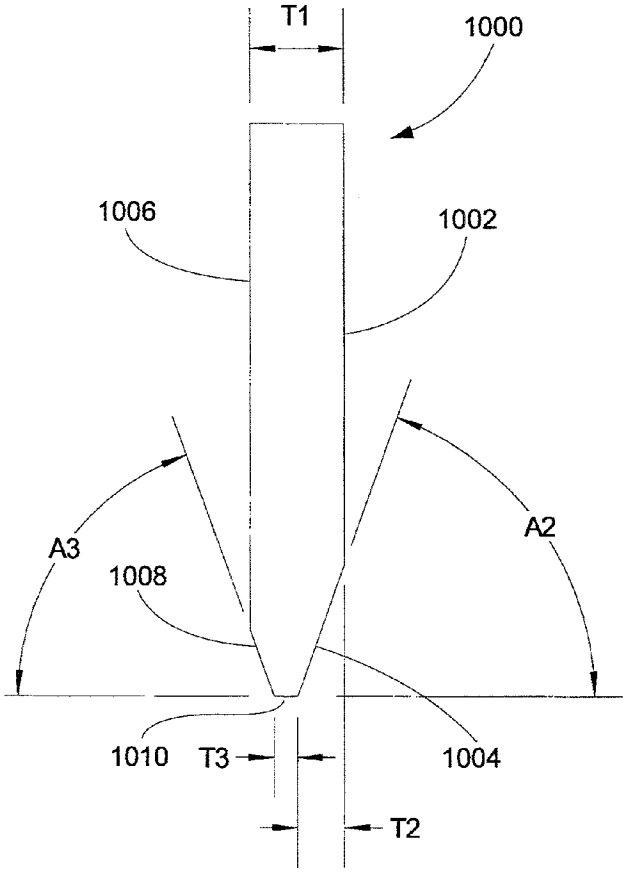
FIG. 10 is a cross-sectional view of another exemplary cleaning member.

FIG. 10 illustrates another embodiment of a blade 1000 that may be used with embodiments of the invention. The exemplary blade 1000 is made of a steel plate that is about the same length as the brushroll and/or the friction surfaces with which it is used. In an exemplary embodiment, the blade 1000 has a thickness T1 of about 3 millimeters (mm). The front side 1002 of the blade (i.e., the side that the friction surfaces move towards as the agitator rotates) has a front chamfer 1004 that extends at an angle A2 of about 70 degrees relative a line perpendicular to the front side 1002 (or about 20 degrees relative to the plane of the front side 1002 or to the centerline of the blade 1000). The front chamfer 1004 is cut to a depth T2 of about 1.5 mm. In addition, the rear side 1006 of the blade (the side opposite the front side 1002) may have a chamfer 1008 at an angle A3 of about 70 degrees relative a line perpendicular to the rear side 1006 (or about 20 degrees relative to the plane of the rear side 1006 or to the centerline of the blade 1000). The rear chamfer 1008 may have a depth sufficient to leave a generally flat contact surface 1010 having a width T3 of about 1.0 mm. With the exemplary 3 millimeter blade 1000, the depth of the rear chamfer 1008 would be about 0.5 mm to obtain a 1.0 mm contact surface 1010. The height of the blade (i.e., the distance from the contact surface 1010 and the far end) may vary depending on the intended use, height of the bristles, height of the friction surfaces, and so on. it has been found that a height of about 30 mm is suitable under some circumstances. In addition, the edges of the chamfers 1004, 1008 where they meet the front and rear sides 1002, 1006, and/or the contact surface 1010 may be rounded to help reduce wear on the bristles. While the foregoing blade may be suitable, other blade designs will become apparent to the practitioner without undue experimentation. For example, other dimensions or shape profiles may be used, or the blade may be reversed with respect to the direction of the agitator's rotation.

Figure 11A:
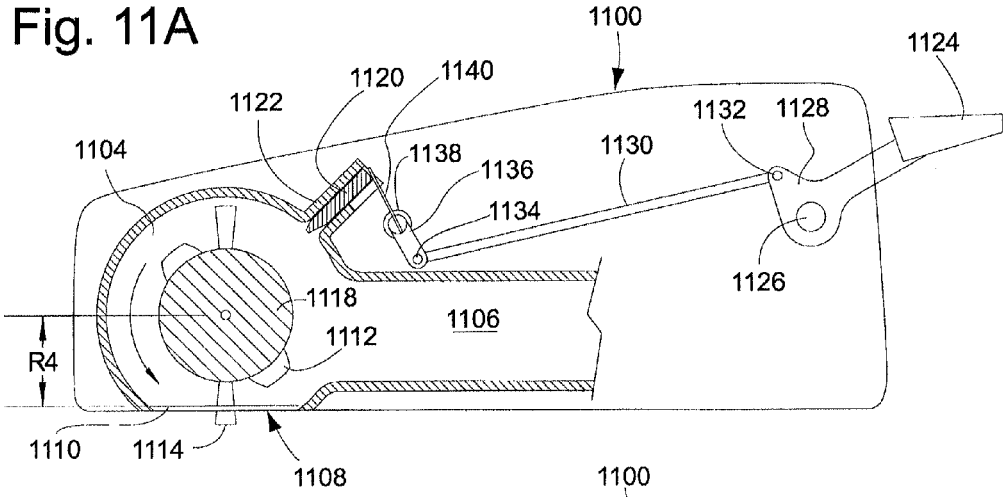
FIGS. 11A-C are cross-sectional views of a cleaning head incorporating another embodiment of a brushroll cleaning device, shown in three operating positions.
Figure 11B:
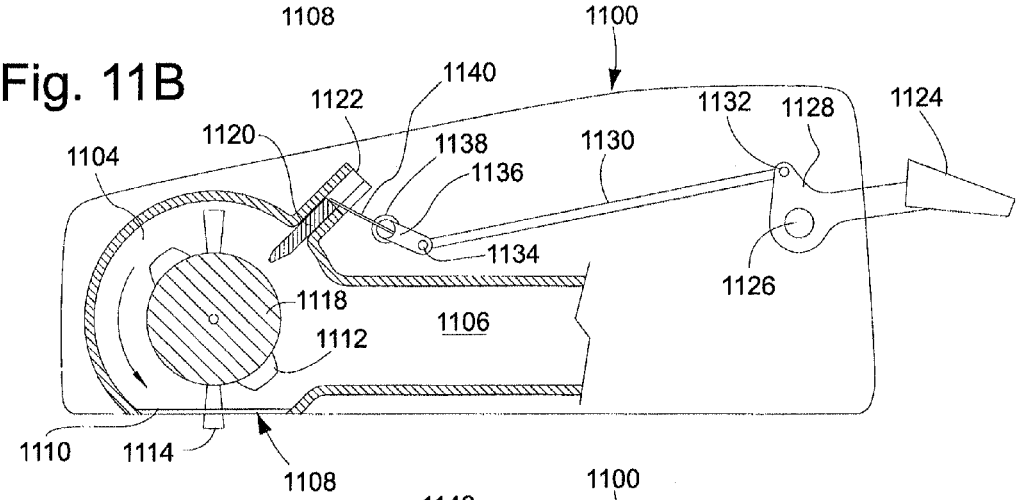
Figure 11C:
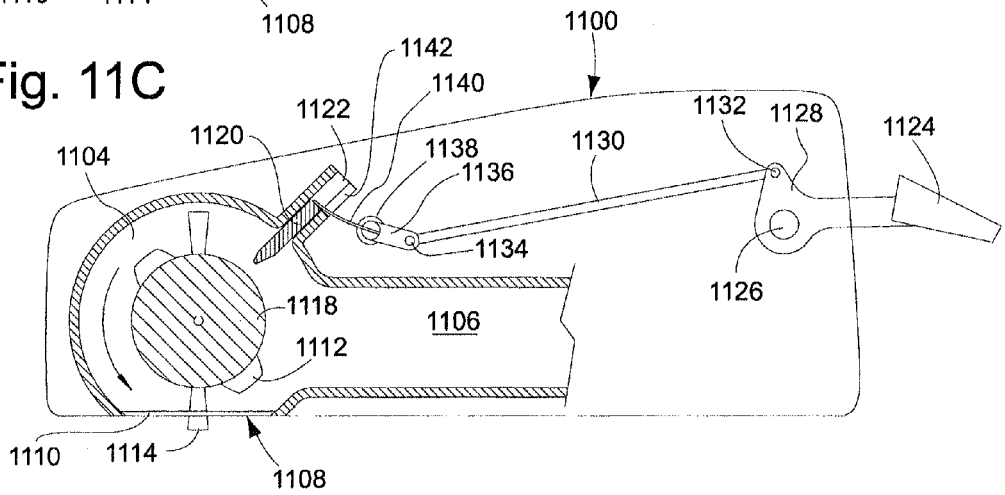

FIGS. 11A-11C illustrate a cross-sectional view of another exemplary embodiment of a brushroll or agitator cleaning device of the present invention. Here, a vacuum cleaner cleaning head 1100 is shown schematically. The cleaning head 1100 may comprise a powerhead for a central or canister vacuum cleaner, or the nozzle base of an upright vacuum, or any other vacuum cleaning device. The cleaning head includes an agitator 1102 mounted in an agitator chamber 1104. An air passage 1106 extends from the agitator chamber 1104 to a vacuum source (not shown), as known in the art. The agitator chamber 1104 has a downwardly-facing opening 1108 to receive incoming dirt and debris. One or more ribs 1110 may extend across the opening 1108 to prevent large objects, such as clothing and electrical cords, from entering through the opening 1108. Such ribs are typically made from plastic and formed with the cleaning head 1100 housing members, or made from steel wire and installed into the cleaning head 1100 housing members.

As shown in the Figures, the agitator 1102 includes friction surfaces 1112 and bristles 1114, such as described previously herein or otherwise constructed. The bristles 1114 may extend through the opening 1108 to agitate the underlying surface. The bristles 1114 may straddle the ribs 1110, or the ribs 1110 may simply pass through the fibers forming each bristle 1114. The friction surfaces 1112 also may have a radial height that equals or exceeds the distance from the rotating axis of the agitator 1102 to the ribs 1110. In such a case, the ribs 1110 may have to be moved or contoured to avoid contact with the frictions surfaces 1112, or the friction surfaces 1112 may be grooved to avoid contact with the ribs 1110 (or both). In other embodiments, the frictions surfaces 1112 may not have sufficient radial height to contact the ribs 1110.

It may be desirable to maintain a distance, for example a distance of about 2 mm, between the friction surfaces 1112 and the ribs 1110. Also, it may be desirable for the bristles 1114 to extend about 2.5 mm past the bottom edge of the opening 1108, or more, to provide more favorable cleaning performance. Where a steel rib having a thickness of about 1.5 mm is used, one possible arrangement is to have bristles 1116 that are about 10 mm long, and friction surfaces that are about 4 mm tall relative to a cylindrical agitator spindle 1118. Other variations, however, are certainly possible, and the exemplary dimensions described in this paragraph are not to be understood as limiting the claimed invention unless numerical values for such dimensions are specifically recited in the appended claims.

The exemplary embodiment of FIGS. 11A-C also illustrate a cleaning member having the form of a blade 1120. The blade 1120 is mounted in a slot-like track 1122. The track 1122 is angled back from the vertical direction to help reduce the overall height of the cleaning head 1100. Springs, such as those shown in the embodiment of FIGS. 2A and 2B, may be used to resiliently mount the blade 1120 in the track 1122. When not in use, the blade 1120 is retracted into the track 1122, such as shown in FIG. 11A, where it can not contact the bristles 1114 or friction surfaces 1112. A foot pedal 1124 is provided for the user to depress when it is desired to clean the agitator 1102. The foot pedal 1124 is mounted on a pivot 1126, and includes a rocker arm 1128. A link arm 1130 is connected to the rocker arm 1128 at a pivot 1132 that is offset from the rocker arm pivot 1126. Thus, as the foot pedal 1124 is depressed, the link arm 1130 is pulled backwards towards the rear of the cleaning head 1100. The other end of the link arm 1130 is mounted by another pivot 1134 to a crank arm 1136. The crank arm 1136 comprises, for example, a shaft that is pivotally mounted on one or more bushings 1138, so that movement of the link arm 1130 pivots the crank arm 1136. The crank arm 1136 includes one or more leaf springs 1140 that extend to the distal end of the blade 1120 (the distal end being the end farthest from the agitator 1102). The leaf springs 1140 rotate with the crank arm 1136, and as they do, they press the blade 1120 into contact with the friction surfaces 1112, as shown in FIG. 11B.

The use of leaf springs 1140 or other flexible or compressible members to transmit movement of the user-operated blade actuating mechanism (in this example, the foot pedal 1124) helps prevent the user from applying excessive force to the blade 1120 and frictions surfaces 1112. Such force can unnecessarily increase wear, increase the torque on the agitator drive components, or even damage parts. As shown in FIG. 11C, if the user presses the foot pedal 1124 beyond a certain point, the leaf spring 1140 will flex, thereby preventing the application of excessive force to the blade 1120. The leaf spring 1140 in this particular embodiment also may abut the end of a slot once the blade 1120 is in the furthest desirable position, so that any additional force applied to the foot pedal 1124 will be applied to the portion of the blade track 1122 located at the end of the slot 1140, rather than to the blade 1120. The use of a flexible member such as the leaf springs 1140 also permits the blade 1120 to retract into the track 1122 if it encounters an object that it can not cut or tear from the agitator 1102. The leaf springs 1140 or other flexible member also help isolate the user from vibrations that might be generated when the blade 1120 contacts the bristles 1114 and friction surfaces 1112. In the shown embodiment, the leaf spring 1140 may comprise typical spring steel, plastic, or other materials. The geometry and material for the leaf springs 1140 may be regulated to obtain desirable overload protection and other benefits, as will be appreciated by persons of ordinary skill in the art.

The foregoing exemplary embodiment provides just one example of a flexible member that is used to convey the user-generated operating force to the blade. In other embodiments, the flexible member may comprise other kinds of springs, such as coil springs, a pneumatic or hydraulic cylinder, elastomers such as open- or closed-cell foam blocks, rubber, and so on. In addition, the flexible member may operate in compression, as a cantilevered member (as shown), or in tension. For example, the link arm 1130 may comprise a coil spring that operates in tension. It will also be understood that other kinds of linkage may be used to transmit force from the user (or from an automated actuation member, such as a solenoid) to the blade.

Referring back to FIG. 1, the exemplary motor 114 driving the agitator 100 comprises a DC or AC motor. Where an electric motor 114 is used, it may be desirable to provide an overload mechanism 118, such a microcircuit or other solid state, electronic, or electromechanical device, to disable the motor 114 when a fault condition occurs, such as when a large object is caught in the agitator causing the motor current to exceed a predetermined safe operating level. Such devices are well-known in the art. When an agitator cleaner such as described herein is used, the cleaning mechanism may generate torque on the agitator that causes the current through the motor to increase. As such, it may be desirable to program or configure the overload mechanism 118 so that it is disabled or uses a higher threshold cutoff value whenever the agitator cleaning mechanism is being operated. For example, the agitator cleaner may contact a microswitch 312 (FIG. 3A) that is electrically connected to the overload mechanism 118. When activated, the microswitch 312 reprograms the overload mechanism 118 to allow a greater current threshold, deactivates the overload mechanism 118, or otherwise prevents the overload mechanism 118 from shutting off the motor 114 during agitator cleaning operations.

For example, a typical overload mechanism for a vacuum cleaner agitator may have a microcontroller that monitors the running current of the motor using a load resistor. At a present trip current, such as 3.15 amps, the microcontroller will break the circuit to the motor. This current is selected to prevent damage from high heats that occur when the motor is operated over a sustained period at a higher than expected torque value. In typical applications, this can happen quickly, such as when there is an obstruction that stops the agitator, or gradually, such as when the agitator is operated on dense carpet for a sustained period of time. During agitator cleaning, it has been found that a typical motor might experience current values exceeding 3.15 amps by as much as 0.65 amps. To accommodate this, the microcontroller can be programmed to allow excessive current for the relatively short period of time it takes to clean the brushroll. It has been found that about 2.12 grams of hair can be cleaned from a brushroll is as little as 10 seconds. Since the cleaning duration is so short, it is believed that the motor can be safely operated at the necessary current during cleaning without materially increasing wear or damage to the motor or other parts. A person of ordinary skill in the art will readily understand how to create logic circuits to accomplish the foregoing, examples of circuit breakers that operate at one threshold level during normal operation, and at another threshold level during agitator cleaning operations. Examples of circuit breakers used in various cleaners include those in U.S. Pat. Nos. 4,370,777; 6,042,656; and 6,351,872, which references are incorporated herein.

In addition, some vacuum cleaners may use overload protection devices that mechanically disengage the motor from the agitator when an overload condition is detected. For example, a clutch requiring a certain threshold torque may be used to disengage the agitator from the motor. In one experiment, it was found that an overload mechanism may require a torque of about 830 milliNewton·meters (mNm) to disengage. It is believed that embodiments of the present invention can be operated at a torque value of about 190 mNm, which should be sufficiently low to operate even in conjunction with mechanical clutch overload members. Examples of a agitator clutches are shown in U.S. Pat. Nos. 4,317,253; 4,702,122; and 7,228,593 and U.S. Publication No. 2008/0105510, which references are incorporated herein.

Figure 12:
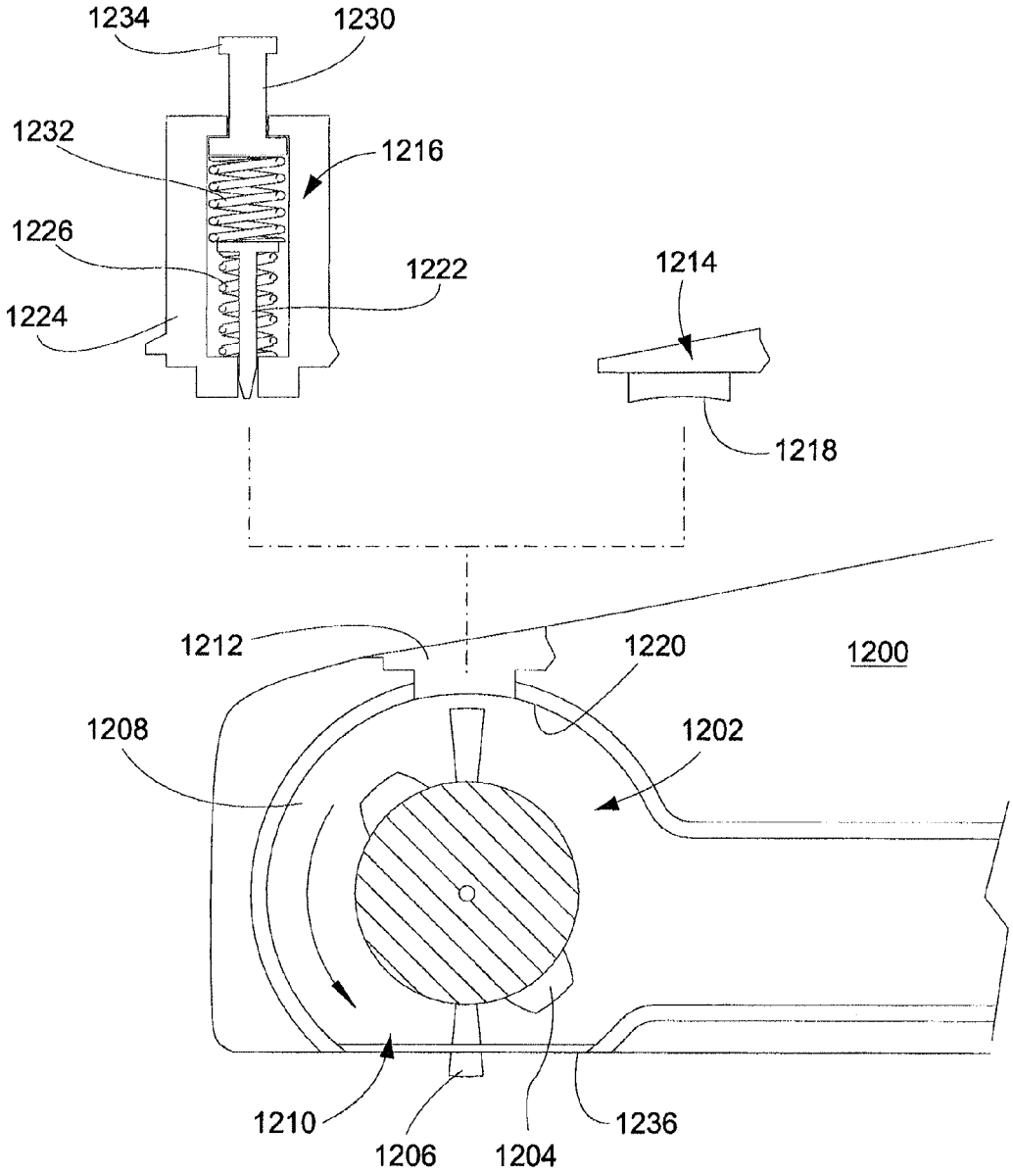
FIG. 12 is a schematic side view of another agitator having a removable cleaning system.

As noted above, in one exemplary embodiment, an agitator cleaning device may be provided as a separate part that is attached to the cleaning head when it is desired to perform cleaning, and removed when it is not in use. An example of such a device is shown in FIG. 12. here, a cleaning head 1200 is provided with an agitator 1202 having friction surfaces 1204 and bristles 1206. The agitator 1202 is rotatably mounted in a chamber 1208 having a lower inlet 1210. The chamber 1208 also includes an upper opening 1212 that is adapted to receive either a cover 1214 or an agitator cleaner 1216. Any kind of attachment device such as snaps, screws, or the like, may be used to hold the cover 1214 and agitator cleaner 1216 in place. The cover 1214 may include a lower surface 1218 that is contoured to match the chamber's inner wall 1220 to help reduce air turbulence.

The agitator cleaner 1216 may be installed into the opening 1212 when it is desired to clean the agitator 1202. The agitator cleaner 1216 may comprise any construction, such as those previously described in the various exemplary embodiments described herein. In the shown exemplary embodiment, the agitator cleaner 1216 comprises a blade 1222 that slides in a housing 1224. The blade 1222 includes two end springs 1226, such as those shown in FIGS. 2A and 2B (as this is an end view, only one is visible), that are located at the ends of the blade 1222 to help distribute the pressure applied by the blade 1222 across the agitator's length. The blade 1222 is operated by a button 1230 that may be located at the longitudinal center of the blade 1222 (i.e., the center with respect to the length in the direction parallel to the rotating axis of the agitator 1202). The button 1230 applies the operating force to the top of the blade 1222 through an actuating spring 1232. The button 1230 includes an upper lip 1234 that contacts the top of the housing 1224 before the actuating spring 1232 is fully compressed, and thus the actuating spring 1232 prevents the user from applying excessive force to the blade 1222.

Of course, the foregoing embodiment is only one example of a removable cleaning device, and other configurations and arrangements for removable cleaning devices will be apparent to persons of ordinary skill in the art in view of the present disclosure. For example, in another embodiment, the cleaning device 1216 may be adapted to install on the chamber inlet 1210. This may be readily accomplished by inverting the cleaning device 1216, providing cutouts in the blade 1222 to accommodate any ribs 1236 in the inlet 1210, and providing clips or other fasteners to mount the cleaning device 1216 in the inlet 1210.

It will be recognized and understood that the embodiments described above are not intended to limit the inventions set forth in the appended claims. Various modifications may be made to these embodiments without departing from the spirit of the invention and the scope of the claims. For example, in alternative embodiments the agitator cleaning feature may be modified by reversing the locations of the friction surface and the blade. It will also be understood that embodiments may be used with vacuum cleaners or other cleaning devices having rotary cleaning components, such as sweepers that do not use a vacuum to aid with removal of dirt and debris. It will also be understood that the disclosure of particular values for dust recovery, current measurement, torque and the like, are likely to vary under different circumstances and are provided as non-limiting examples. These and other modifications are included within the scope of the appended claims.

What is claimed:

1. A vacuum cleaner agitator system comprising:

a housing;

an inlet nozzle through a lower surface of the housing;

an agitator chamber in the housing adjacent to and in fluid communication with the inlet nozzle;

a rotary agitator comprising:

a spindle extending along a longitudinal direction from a first spindle end to a second spindle end, the spindle being mounted to the housing within the agitator chamber, and rotatable about a rotation axis that is parallel with the longitudinal direction, agitating devices arranged between the first spindle end and the second spindle end and projecting from the spindle to a first radial height at which the agitating devices extend through the inlet nozzle when the spindle rotates, and one or more friction surfaces projecting from the spindle to a second radial height that is less than the first radial height and dimensioned such that the one or more friction surfaces do not extend through the inlet nozzle when the spindle rotates; and a cleaning blade comprising a linear contact surface extending along the longitudinal direction, the cleaning blade being mounted to the housing adjacent the spindle and movable between a first position in which the contact surface is spaced from the one or more friction surfaces when the spindle rotates, and a second position in which the contact surface engages the one or more friction surfaces when the spindle rotates; wherein the one or more friction surfaces and the agitating devices are spaced about a circumference of the spindle a sufficient distance to prevent the agitating devices from being pinched between the one or more friction surfaces and the linear contact surface when the cleaning blade is in the second position and the agitator is rotated in at least one direction.

2. The vacuum cleaner agitator system of claim 1, wherein the agitating devices comprise at least one helical row of bristles extending from a first point proximal to the first spindle end to a second point proximal to the second spindle end.

3. The vacuum cleaner agitator system of claim 2, wherein the one or more friction surfaces extend continuously from the first point to the second point.

4. The vacuum cleaner agitator system of claim 2, wherein the linear contact surface extends continuously from the first point to the second point.

5. The vacuum cleaner agitator system of claim 2, wherein the cleaning blade comprises a metal plate that extends continuously from the first point to the second point.

6. The vacuum cleaner agitator system of claim 1, wherein the agitating devices comprise two helical rows of bristles extending from the spindle on opposite sides of the rotation axis, and the one or more friction surfaces comprise two helical protrusions extending from the spindle on opposite sides of the rotation axis, each friction surface being circumferentially spaced between the two helical rows of bristles.

7. The vacuum cleaner agitator system of claim 1, wherein the one or more friction surfaces comprise one or more helical protrusions.

8. The vacuum cleaner agitator system of claim 1, wherein:

the rotary agitator further comprises a pulley located between the first spindle end and the second spindle end;

the agitating devices are arranged between the first spindle end and the pulley; and the one or more friction surfaces extend continuously between the first spindle end and the pulley.

9. The vacuum cleaner agitator system of claim 8, wherein the linear contact surface extends continuously between the first spindle end and the pulley.

10. The vacuum cleaner agitator system of claim 1, wherein the linear contact surface continuously engages at least one point on the one or more friction surfaces throughout a complete rotation of the rotary agitator when the cleaning blade is in the second position.

11. The vacuum cleaner agitator system of claim 1, wherein the linear contact surface is spaced from the rotation axis by a distance greater than the first radial height when the cleaning blade is in the first position.

12. The vacuum cleaner agitator system of claim 1, wherein the cleaning blade contacts the one or more friction surfaces when the cleaning blade is in the second position.

13. The vacuum cleaner agitator system of claim 1, wherein each of the one or more friction surfaces is located around a circumference of the spindle about 40 degrees in advance of a respective agitating device.

14. The vacuum cleaner agitator system of claim 1, wherein the second radial height is about 6 millimeters less than the first radial height.

15. A vacuum cleaner agitator system comprising:

a housing;

an inlet nozzle through a lower surface of the housing;

an agitator chamber in the housing adjacent to and in fluid communication with the inlet nozzle;

a rotary agitator comprising:

a spindle extending along a longitudinal direction from a first spindle end to a second spindle end, the spindle being mounted to the housing within the agitator chamber, and rotatable about a rotation axis that is parallel with the longitudinal direction, agitating devices arranged between the first spindle end and the second spindle end and projecting from the spindle to a first radial height at which the agitating devices extend through the inlet nozzle when the spindle rotates, and one or more friction surfaces projecting from the spindle to a second radial height that is less than the first radial height; and a cleaning blade comprising a linear contact surface extending along the longitudinal direction, the cleaning blade being mounted to the housing adjacent the spindle and movable between a first position in which the contact surface is spaced from the one or more friction surfaces when the spindle rotates, and a second position in which the contact surface engages the one or more friction surfaces when the spindle rotates; wherein the one or more friction surfaces and the agitating devices are spaced about a circumference of the spindle by a circumferential distance, and a radial distance between the first radial height and a surface of the spindle adjacent each agitating device is less than the circumferential distance such that the agitating devices cannot contact the one or more friction surfaces when the agitator is rotated in at least one direction.

16. The vacuum cleaner agitator system of claim 15, wherein the agitating devices comprise bristles.

17. The vacuum cleaner agitator system of claim 15, wherein the agitating devices comprise flexible flaps.

18. The vacuum cleaner agitator system of claim 15, wherein the second radial height is dimensioned such that the one or more friction surfaces do not extend through the inlet nozzle when the spindle rotates.

19. The vacuum cleaner agitator system of claim 15, wherein the agitating devices extend in at least one helical row from a first point proximal to the first spindle end to a second point proximal to the second spindle end.

20. The vacuum cleaner agitator system of claim 15, wherein the linear contact surface comprises an edge of a metal plate that continuously engages at least one point on the one or more friction surfaces throughout a complete rotation of the rotary agitator when the cleaning blade is in the second position.

* * * * *